US011462354B2

(12) United States Patent
Inaba et al.

(10) Patent No.: US 11,462,354 B2
(45) Date of Patent: Oct. 4, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kazuhiro Inaba, Mie (JP); Kouhei Yoshikawa, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 536 days.

(21) Appl. No.: 16/605,568

(22) PCT Filed: Apr. 10, 2018

(86) PCT No.: PCT/JP2018/015120

§ 371 (c)(1),
(2) Date: Oct. 16, 2019

(87) PCT Pub. No.: WO2018/198763

PCT Pub. Date: Nov. 1, 2018

(65) Prior Publication Data

US 2020/0075230 A1 Mar. 5, 2020

(30) Foreign Application Priority Data

Apr. 27, 2017 (JP) ..... JP2017-088992

(51) Int. Cl.
*H01F 27/42* (2006.01)
*H01F 27/32* (2006.01)
(Continued)

(52) U.S. Cl.
CPC ..... *H01F 27/32* (2013.01); *H01F 17/04* (2013.01); *H01F 27/022* (2013.01);
(Continued)

(58) Field of Classification Search
USPC ..... 336/199, 221, 198, 220
See application file for complete search history.

(56) References Cited

U.S. PATENT DOCUMENTS

2014/0218158 A1* 8/2014 Miyamoto ..... H01F 37/00 336/198
2016/0055953 A1* 2/2016 Hirata ..... H01F 27/306 336/96

(Continued)

FOREIGN PATENT DOCUMENTS

JP 2008-060593 A 3/2008
JP 2010-238798 A 10/2010

(Continued)

OTHER PUBLICATIONS

International Search Report, Application No. PCT/JP2018/015120, dated Jun. 26, 2018. ISA/Japan Patent Office.

*Primary Examiner* — Shawki S Ismail
*Assistant Examiner* — Kazi S Hossain
(74) *Attorney, Agent, or Firm* — Honigman LLP

(57) ABSTRACT

Provided is a reactor including: a coil having wound portions; and a magnetic core including core pieces having inner core portions arranged inside of the wound portions. The core pieces are molded bodies of a composite material including a magnetic powder and a resin, and the reactor includes: projections that are integrally molded with and protrude from outer peripheral surfaces of the inner core portions, and that position the wound portions in radial directions by coming into contact with inner peripheral surfaces of the wound portions; and inner resin portions that fill spaces between the inner peripheral surfaces of the wound portions and the outer peripheral surfaces of the inner core portions excluding the projections.

8 Claims, 6 Drawing Sheets

(51) Int. Cl.

| | |
|---|---|
| ***H01F 17/04*** | (2006.01) |
| ***H01F 27/02*** | (2006.01) |
| ***H01F 27/255*** | (2006.01) |
| ***H01F 27/30*** | (2006.01) |
| ***H01F 37/00*** | (2006.01) |
| ***H01F 41/06*** | (2016.01) |
| ***H01F 41/12*** | (2006.01) |

(52) U.S. Cl.
CPC ..... *H01F 27/255* (2013.01); *H01F 27/306* (2013.01); *H01F 37/00* (2013.01); *H01F 41/06* (2013.01); *H01F 41/12* (2013.01); *H01F 2017/048* (2013.01)

(56) References Cited

U.S. PATENT DOCUMENTS

| | | | | |
|---|---|---|---|---|
| 2016/0322150 | A1* | 11/2016 | Inaba | H01F 27/2876 |
| 2018/0040407 | A1* | 2/2018 | Yamamoto | H01F 3/14 |
| 2018/0211758 | A1 | 7/2018 | Shitama et al. | |

FOREIGN PATENT DOCUMENTS

| | | | |
|---|---|---|---|
| JP | 2016-149453 | A | 8/2016 |
| WO | 2015-190215 | A1 | 12/2015 |

* cited by examiner

REACTOR

CROSS-REFERENCE TO RELATED APPLICATIONS

This application is the U.S. national stage of PCT/JP2018/015120 filed on Apr. 10, 2018, which claims priority of Japanese Patent Application No. JP 2017-088992, filed on Apr. 27, 2017, the contents of which are incorporated herein.

TECHNICAL FIELD

The present disclosure relates to a reactor.

BACKGROUND

A reactor is one component of a circuit that performs a voltage boost operation and a voltage lowering operation. For example, JP 2017-28142A discloses a reactor including: a coil having wound portions; a magnetic core that is arranged inside and outside of the coil (wound portions) to form a closed magnetic path; and an insulating interposed member that is interposed between the coil (wound portions) and the magnetic core. The reactor according to JP 2017-28142A includes inner resin portions that fill spaces between the inner peripheral surfaces of the wound portions of the coil and the outer peripheral surfaces of the inner core portions of the magnetic core arranged inside of the wound portions.

JP 2017-28142A describes that the insulating interposed member is constituted by inner interposed members that are interposed between the inner peripheral surfaces of the wound portions and the outer peripheral surfaces of the inner core portions, and end surface interposed members that are interposed between the end surfaces of the wound portions and the outer core portions. Also, the magnetic core is constituted by combining multiple divided cores (core pieces), the inner core portions are constituted by multiple divided cores and gaps formed between the divided cores, and the divided cores are pressed powder molded bodies.

There has been demand for a further reduction of the size of the reactor, and from this viewpoint, it is desirable to reduce the size of the clearances between the inner peripheral surfaces of the wound portions and the outer peripheral surfaces of the inner core portions.

In the above-described conventional reactor, the wound portions and the inner core portions are positioned by arranging the inner interposed members so as to be interposed between the inner peripheral surfaces of the wound portions and the outer peripheral surfaces of the inner core portions. In general, the inner interposed members are made of resin and have a certain degree of thickness (e.g., 2 mm or more) in order to ensure mechanical strength. For this reason, in the conventional reactor, the clearances between the wound portions and the inner core portions have been large. Also, if the core pieces forming the magnetic core are pressed powder molded bodies as with the conventional reactor, the pressed powder molded bodies have a comparatively high relative permeability, and therefore it is necessary to provide the magnetic core with gaps for adjusting the inductance of the reactor. If gaps are formed in the inner core portions, magnetic flux leakage from the gaps enters the wound portions and causes eddy current loss in the wound portions in some cases. In view of this, in order to make it less likely that the conventional reactor will be influenced by magnetic flux leakage from the gaps, the clearances between the wound portions and the inner core portions have needed to be increased in size to a certain extent. Accordingly, since the clearances between the wound portions and the inner core portions are larger, it has been difficult to reduce the size of the conventional reactor.

In view of this, one object of the present disclosure is to provide a reactor according to which wound portions and inner core portions can be positioned using a simple configuration, and clearances between the wound portions and the inner core portions can be made smaller.

SUMMARY

A reactor according to the present disclosure is a reactor including a coil having wound portions, and a magnetic core including core pieces having inner core portions arranged inside of the wound portions. The core pieces are molded bodies of a composite material including a magnetic powder and a resin. The reactor includes projections that are integrally molded with and protrude from outer peripheral surfaces of the inner core portions, and that position the wound portions in radial directions by coming into contact with inner peripheral surfaces of the wound portions; and inner resin portions that fill spaces between the inner peripheral surfaces of the wound portions and the outer peripheral surfaces of the inner core portions excluding the projections.

With the reactor of the present disclosure, wound portions and inner core portions can be positioned using a simple configuration, and clearances between the wound portions and the inner core portions can be made smaller.

DETAILED DESCRIPTION OF PREFERRED EMBODIMENTS

Figure 1:
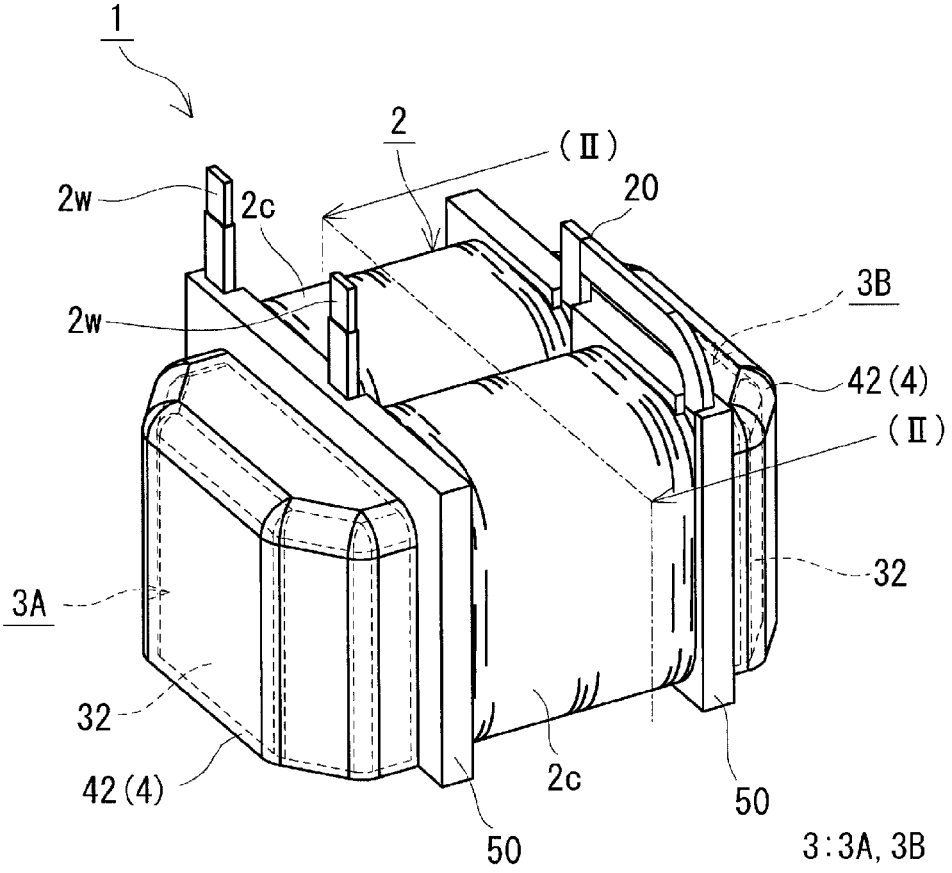
FIG. 1 is a schematic perspective view of a reactor according to Embodiment 1.

First, embodiments of the present disclosure will be listed and described.

A reactor according to one aspect of the present disclosure is a reactor including a coil having wound portions, and a magnetic core including core pieces having inner core portions arranged inside of the wound portions. The core pieces are molded bodies of a composite material including a magnetic powder and a resin, and the reactor includes projections that are integrally molded with and protrude from outer peripheral surfaces of the inner core portions, and that position the wound portions in radial directions by coming into contact with inner peripheral surfaces of the wound portions; and inner resin portions that fill spaces between the inner peripheral surfaces of the wound portions and the outer peripheral surfaces of the inner core portions excluding the projections.

If the core pieces forming the magnetic core are molded bodies of a composite material including a magnetic powder and a resin, the molded bodies of a composite material have comparatively lower relative permeability compared to pressed powder molded bodies, and therefore there is no need to provide the magnetic core with gaps for adjusting the inductance of the reactor, or even if gaps are provided, the gaps may be small. Thus, with the above-described reactor, due to the core pieces with the inner core portions being molded bodies of a composite material, magnetic flux leakage is not likely to occur, and therefore the clearances between the inner peripheral surfaces of the wound portions and the outer peripheral surfaces of the inner core portions can be made smaller. Also, with the above-described reactor, due to the fact that projections that are molded integrally with and protrude from the outer peripheral surfaces of the inner core portions are included and the wound portions are positioned in radial directions with respect to the inner core portions using the projections, the inner interposed members that were conventionally interposed between the wound portions and the inner core portions are no longer needed. For this reason, the clearances between the wound portions and the inner core portions can be made small, and the inner core portions can be positioned inside of the wound portions. Furthermore, due to the inner resin portions being included between the inner peripheral surfaces of the wound portions and the outer peripheral surfaces of the inner core portions excluding the projections, the inner core portions can be held inside of the wound portions. Accordingly, with the above-described reactor, the wound portions and the inner core portions can be positioned using a simple configuration, the clearances between the wound portions and the inner core portions can be made smaller, and a reduction in size can be achieved.

The molded body of the composite material can be molded using a resin molding method such as injection molding or cast molding, and if a core portion in which projections are integrally molded on the outer peripheral surfaces of the inner core portions is constituted by a molded body of a composite material, a high dimensional accuracy is easily obtained. With the above-described reactor, due to the projections protruding from the outer peripheral surfaces of the inner core portions, clearances are formed between the inner peripheral surfaces of the wound portions and the outer peripheral surfaces of the inner core portions excluding the projections, and flow paths of resin when performing filling with resin for forming the inner resin portions are ensured. Due to the resin filling the clearances, the inner resin portions are formed.

In one aspect of the above-described reactor, the height of the projections may be 1 mm or less.

Due to the height of the projections being 1 mm or less, the clearances of the wound portions and the inner core portions can be made sufficiently small, and the reactor can be made even smaller. From the viewpoint of ensuring clearances (flow path cross-sectional areas) that are to be flow paths of resin when filled with resin, the lower limit of the height of the projections is preferably 100 μm or more, for example.

In one aspect of the above-described reactor, corner portions of the inner core portions may be chamfered.

Due to the corner portions of the inner core portions being chamfered, the clearances at the corner portions are large, the flow paths of the resin are likely to be ensured, and the formation of the inner resin portions is easier. Also, a magnetic flux is not likely to flow in the corner portions of the inner core portion, and thus the corner portions are not likely to function as effective magnetic paths, and therefore have a comparatively small influence on the effective magnetic path. For this reason, due to the corner portions of the inner core portions being chamfered, it is possible to effectively suppress reduction of the effective magnetic path cross-sectional area while ensuring the flow paths of the resin. Note that a "corner portion" in this context refers to a corner portion in a cross section perpendicular to the axial direction of the inner core portion.

In one aspect of the above-described reactor, the projections may be formed continuously over the entire length along an axial direction of the inner core portions.

Due to the projections being formed along the axial direction on the outer peripheral surfaces of the inner core portions, the resin is more likely to flow along the axial direction of the inner core portions when the clearances between the wound portions and the inner core portions are filled with the resin, and thus formation of the inner resin portions is easier. Also, due to the projections being formed continuously over the entire length of the inner core portions, there are no seams in the projections, and the clearances are divided in the peripheral direction by the projections. For this reason, the resin that flows in the adjacent clearances on both sides of a projection does not merge, and thus it is possible to suppress a case in which a welded portion that occurs at the merge portion of the resin is formed in the inner resin portion. Since the welded portion has deteriorated strength, it is possible to increase the mechanical strength of the inner resin portion by suppressing a case in which the welded portion is formed in the inner resin portion.

In one aspect of the above-described reactor, the reactor may include insulation layers that are arranged on outer peripheral surfaces of the projections and are interposed between the inner peripheral surfaces of the wound portions and the outer peripheral surfaces of the projections.

Due to the insulating layer being arranged on the outer peripheral surfaces of the projections, the insulation between the wound portions and the inner core portions can be made more reliable.

In one aspect of the reactor according to (5) above, the thickness of the insulating layers may be 500 μm or less.

The thickness of the insulation layer need only be a thickness according to which the insulation between the wound portions and the inner core portions can be ensured, and is not particularly limited. However, if it is too thick, the clearances between the wound portions and the inner core portions will increase in size. Due to the thickness of the insulation layer being 500 μm or less, the clearances between the wound portions and the inner core portions can be made sufficiently small, and the reactor can be made smaller. From the viewpoint of ensuring insulation between the wound portions and the inner core portions, the lower limit of the thickness of the insulation layer is preferably 10 μm or more, for example.

Details of Embodiments of the Disclosure

Specific examples of a reactor according to an embodiment of the present disclosure will be described hereinafter with reference to the drawings. Objects with identical names are denoted by identical reference numerals in the drawings. Note that the present disclosure is not limited to these illustrations, but rather is indicated by the claims. All modifications within the meaning and range of equivalency to the claims are intended to be encompassed therein.

Embodiment 1

Configuration of Reactor

Figure 2:
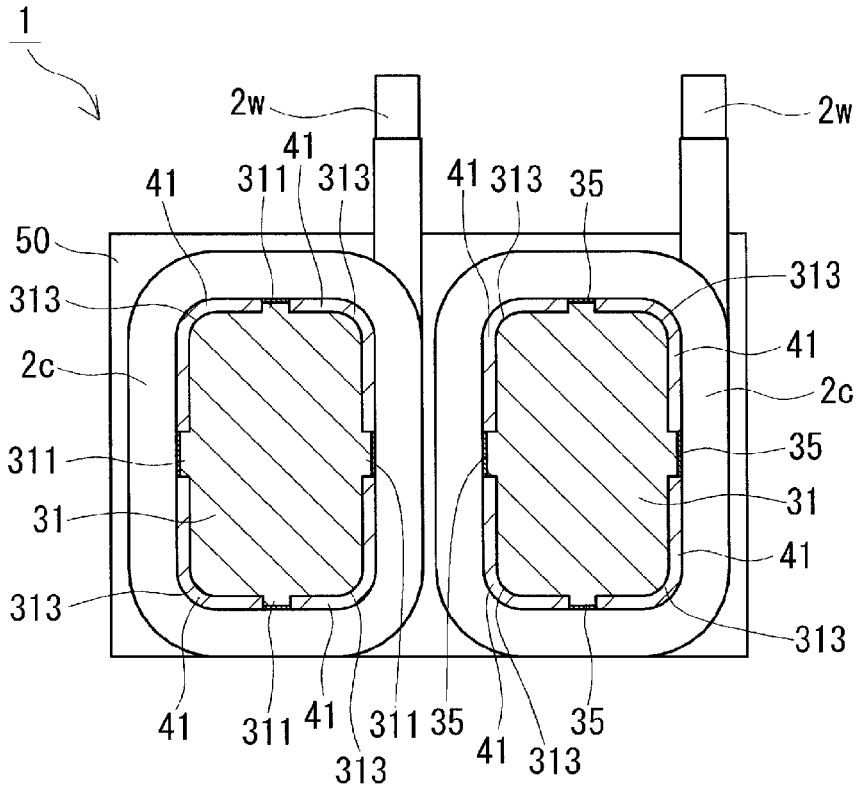
FIG. 2 is a schematic cross-sectional view obtained by cutting along line (II)-(II) shown in FIG. 1.
Figure 3:
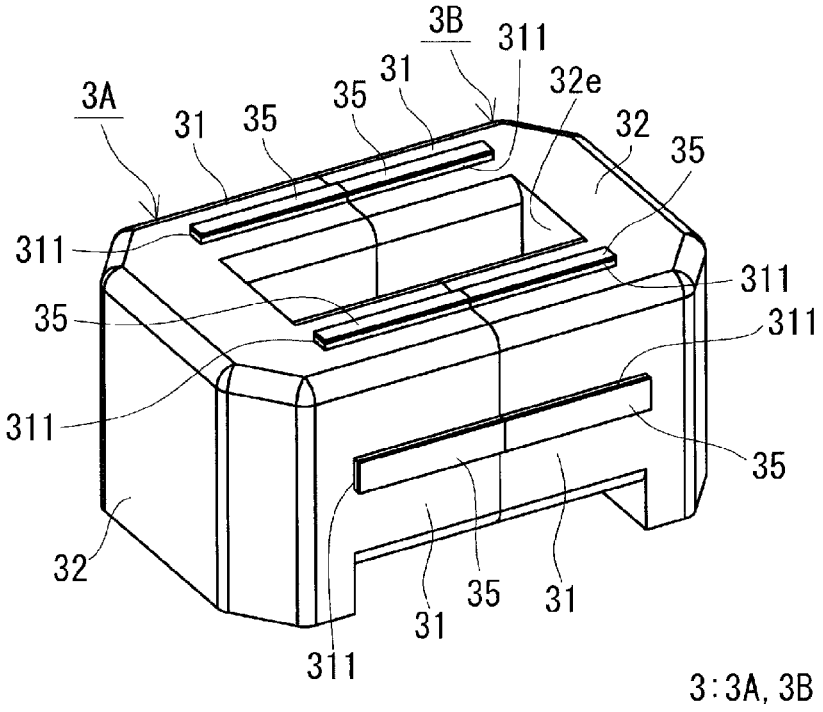
FIG. 3 is a schematic perspective view of a magnetic core included in the reactor according to Embodiment 1.
Figure 4:
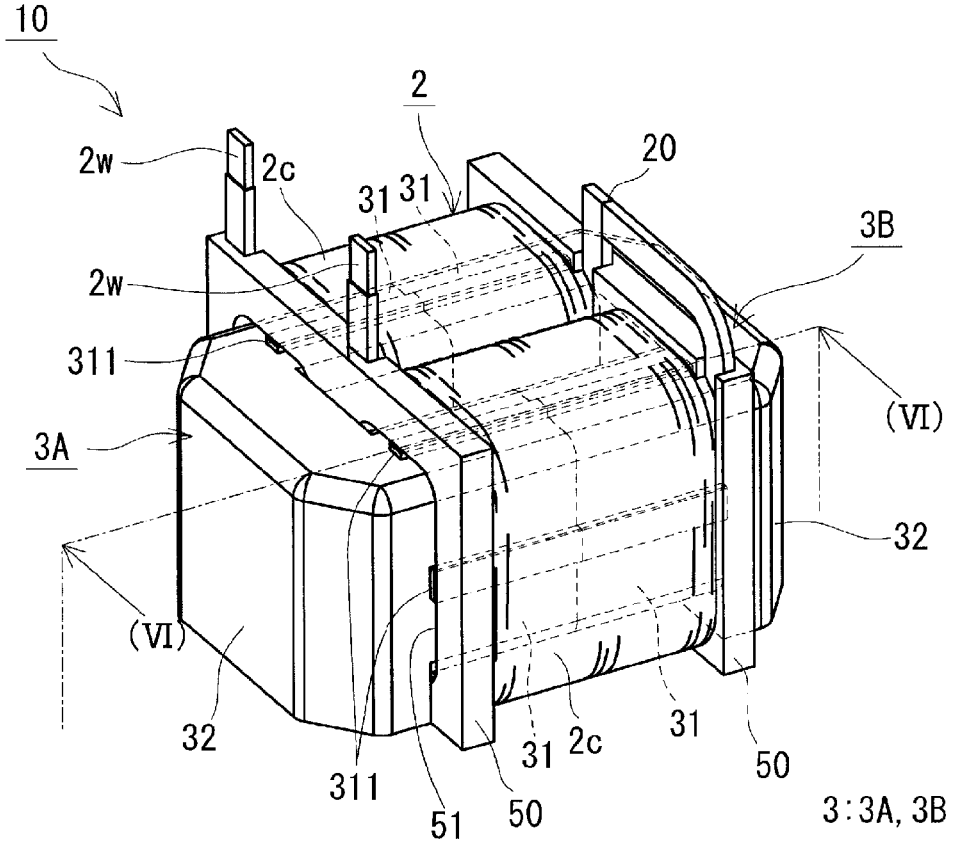
FIG. 4 is a schematic perspective view of a combined body included in the reactor according to Embodiment 1.
Figure 5:
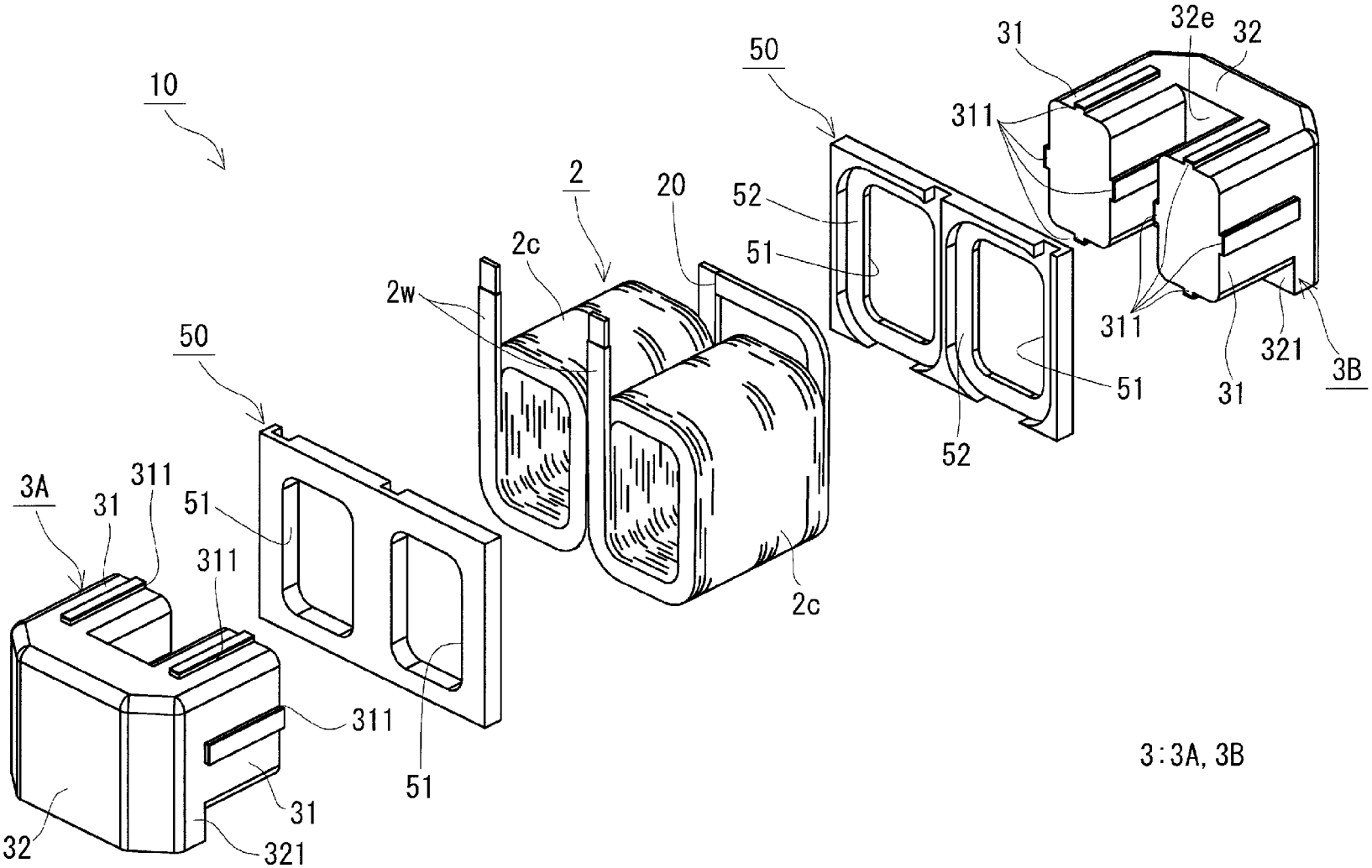
FIG. 5 is a schematic exploded perspective view of the combined body included in the reactor according to Embodiment 1.

A reactor 1 according to Embodiment 1 will be described with reference to FIGS. 1 to 7. As shown in FIGS. 1 to 4, the reactor 1 of Embodiment 1 includes a combined body 10 (see FIG. 4) obtained by combining a coil 2 having two wound portions 2*c* and a magnetic core 3 (see FIG. 3) arranged inside and outside of the wound portions 2*c*. The two wound portions 2*c* are arranged side by side. The magnetic core 3 includes magnetic core pieces, and in this example, the magnetic core 3 includes two core pieces 3A and 3B as shown in FIG. 3. As shown in FIGS. 3 to 5, the core pieces 3A and 3B each include two inner core portions 31, which are arranged inside of the wound portions 2*c*, and an outer core portion 32 that is arranged outside of the wound portions 2*c* and couples the two inner core portions 31. One feature of the reactor 1 is that projections 311 (see FIGS. 2 and 3), which are integrally molded with and protrude from the outer peripheral surfaces of the inner core portions 31, and inner resin portions 41 (see FIG. 2) that fill the spaces between the inner peripheral surfaces of the wound portions 2*c* and the outer peripheral surfaces of the inner core portions 31 are included in the core pieces 3A and 3B including the inner core portions 31.

Also, as shown in FIGS. 1 and 4, the reactor 1 (combined body 10) includes end surface interposed members 50 that are interposed between the end surfaces of the wound portions 2*c* and the outer core portions 32.

Figure 6:
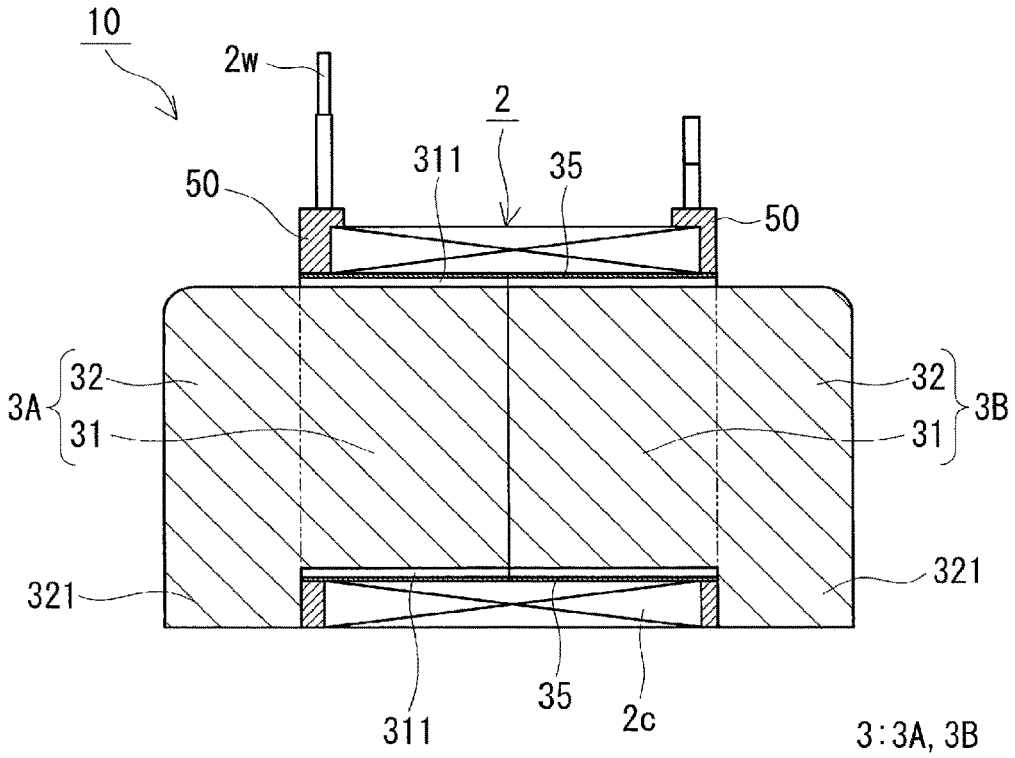
FIG. 6 is a schematic vertical cross-sectional view obtained by cutting along line (VI)-(VI) shown in FIG. 4.

For example, the reactor 1 is installed on an installation target such as a converter case (not shown). Here, in the reactor 1 (the coil 2 and the magnetic core 3), the lower sides of FIGS. 1 to 7 are the installation side facing the installation target, the installation side is "down", the opposite side is "up", and the up-down direction is the vertical direction. Also, the direction in which the wound portions 2*c* (inner core portions 31) are arranged side by side (the left-right direction of FIG. 2) is the horizontal direction, and the direction along the axial direction of the wound portions 2*c* (inner core portions 31) is the length direction. FIG. 2 is a horizontal cross-sectional view obtained by cutting in a horizontal direction perpendicular to the axial direction of the inner core portions 31 (wound portions 2*c*), and FIG. 6 is a vertical cross-sectional view obtained by cutting in the vertical direction along the axial direction of the inner core portions 31 (wound portions 2*c*). Hereinafter, the configuration of the reactor 1 will be described in detail.

Coil

As shown in FIGS. 1, 4, and 5, the coil 2 includes a pair of wound portions 2*c* that are formed by winding two winding wires 2*w* into a spiral shape, the end portions on one side of the winding wires 2*w* that form the two wound portions 2*c* being connected via a bonding portion 20. Both wound portions 2*c* are arranged side by side (in parallel) such that their axial directions are parallel to each other. The bonding portion 20 is formed by bonding the end portions on one side of the winding wires 2*w* pulled out from the wound portions 2*c* through a bonding method such as welding, soldering, or brazing. The end portions on the other side of the winding wires 2*w* are pulled out in an appropriate direction (in this example, upward) from the wound portions 2*c*, terminal fittings (not shown) are attached thereto as appropriate, and the end portions are electrically connected to an external apparatus (not shown) such as a power source. A known coil can be used as the coil 2, and for example, the two wound portions 2*c* may be formed with one continuous winding wire.

Wound Portions

The two wound portions 2*c* are composed of winding wires 2*w* of the same specification, have the same shape, size, winding direction, and number of turns, and adjacent turns forming the wound portions 2*c* are in close contact with each other. For example, the winding wires 2*w* are covered wires (so-called enamel wires) that include a conductor (copper, etc.) and an insulating covering (polyamide imide, etc.) on the outer periphery of the conductor. In this example, as shown in FIG. 5, the wound portions 2*c* are edgewise coils with a quadrangular tube shape (specifically, a rectangular tube shape) obtained by winding wires 2*w*, which are covered flat wires, in an edgewise manner. The shape of the wound portions 2*c* is not particularly limited, and for example, may be circular tube-shaped, elliptical tube-shaped, ovoid tube-shaped (race track shape), or the like. The specifications of the winding wires 2*w* and the wound portions 2*c* can be changed as appropriate.

In this example, the coil 2 (wound portions 2*c*) is not covered by a later-described molded resin portion 4, and when the reactor 1 is formed, the outer peripheral surface of the coil 2 is exposed as shown in FIG. 1. For this reason, heat is easily dissipated to the outside from the coil 2, and the heat dissipating property of the coil 2 can be improved.

In addition, the coil 2 may be a molded coil molded using resin having an electrical insulation property. In this case, the coil 2 is protected from the outside environment (dust, corrosion, etc.), and the mechanical strength of the coil 2 can be improved. Also, the electrical insulation property of the coil 2 can be improved, and the electrical insulation between the coil 2 and the magnetic core 3 can be ensured. For example, due to the inner peripheral surfaces of the wound portions 2*c* being covered with resin, the electrical insulation between the wound portions 2*c* and the inner core portions 31 can be ensured. For example, a thermosetting resin such as epoxy resin, unsaturated polyester resin, urethane resin, or silicone resin, or a thermoplastic resin such as polyphenylene sulfide (PPS) resin, polytetrafluoroethylene (PTFE) resin, liquid crystal polymer (LCP), polyamide (PA) resin such as nylon 6 or nylon 66, polyimide (PI) resin, polybutylene terephthalate (PBT) resin, or acrylonitrile butadiene styrene (ABS) resin can be used as the resin for molding the coil 2.

Alternatively, the coil 2 may be a thermally welded coil in which a welding layer is included between adjacent turns forming the wound portions 2*c* and the adjacent turns are thermally welded. In this case, the shape retention strength of the wound portions 2*c* can be improved, and deformation of the wound portions 2*c*, such as shifting in radial directions of some of the turns forming the wound portions 2*c*, can be suppressed.

Magnetic Core

As shown in FIGS. 3 to 5, the magnetic core 3 includes two U-shaped core pieces 3A and 3B and is formed into a ring shape by combining the two core pieces 3A and 3B. In this example, the core pieces 3A and 3B have identical shapes. For example, if the core piece 3B is rotated 180 degrees in the horizontal direction from the state shown in FIG. 3, it matches the core piece 3A. A magnetic flux flows in the magnetic core due to applying a current to the coil 2, and thus a closed magnetic path is formed.

Core Piece

As shown in FIGS. 3 to 5, the core pieces 3A and 3B each include two inner core portions 31 and an outer core portion 32, and are molded bodies in which the inner core portions 31 and the outer core portion 32 are integrally molded. As shown in FIG. 4, the inner core portions 31 are portions that are inserted into the wound portions 2*c* and are arranged inside of the wound portions 2*c*. In other words, similarly to the wound portions 2*c*, the two inner core portions 31 are arranged side by side (in parallel) such that their axial directions are parallel to each other. The shape of the inner core portions 31 of the core pieces 3A and 3B is a shape that corresponds to the inner peripheral surfaces of the wound portions 2*c*, and in this example, it is a quadrangular column shape (specifically, a rectangular column shape) (see FIG. 2 as well). Also, the lengths in the axial direction of the inner core portions 31 of the core pieces 3A and 3B are the same. Projections 311 are molded integrally on the outer peripheral surfaces of the inner core portions 31. The details of the projections 311 will be described later.

As shown in FIG. 4, the outer core portions 32 are portions that are exposed from the wound portions 2*c* and are arranged outside of the wound portions 2*c*. As shown in FIGS. 3 to 5, the outer core portions 32 of the core pieces 3A and 3B each have a column shape with a hexagonal upper surface, and each have an inner end surface 32*e* (see FIG. 5) that opposes the end surfaces of the wound portions 2*c*. The two inner core portions 31 protrude toward the wound portions 2*c* from the inner end surfaces 32*e* of the outer core portions 32, and the core pieces 3A and 3B are assembled into a ring shape due to the end surfaces of the inner core portions 31 abutting against each other. In this example, as shown in FIG. 5, the outer core portions 32 include downward protruding portions 321 that protrude downward with respect to the inner core portions 31, and the lower surfaces of the outer core portions 32 and the lower surfaces of the wound portions 2*c* are approximately level with each other (see FIG. 6 as well).

The core pieces 3A and 3B are molded bodies that are molded into a predetermined shape, and are formed by molded bodies of a composite material that includes a magnetic powder and a resin. The molded bodies of the composite material are manufactured by performing molding through a resin molding method such as injection molding or cast molding. The molded bodies of the composite material can reduce the relative permeability due to the fact that the resin is interposed between powder particles of the magnetic powder. For this reason, if the core pieces 3A and 3B forming the magnetic core 3 are molded bodies of a composite material, there is no need to provide gaps for adjusting the inductance of the reactor 1 in the magnetic core 3 (e.g., between the core pieces 3A and 3B), or if gaps are provided, the gaps may be small. Accordingly, magnetic flux leakage is not likely to occur in the magnetic core 3 (inner core portions 31), and clearances 34 (see FIG. 7) between the inner peripheral surfaces of the wound portions 2*c* and the outer peripheral surfaces of the inner core portions 31 can be made small. Furthermore, with the molded bodies of the composite material, complex shapes such as those having projections can also be integrally molded easily and have high dimensional accuracy, and therefore if the core pieces 3A and 3B are molded bodies of a composite material, core pieces with high dimensional accuracy can be easily obtained. In addition, if molded bodies of a composite material are used, an effect of being able to reduce iron loss such as eddy current loss can also be expected. If the core pieces 3A and 3B have identical shapes as in the present example, excellent productivity is achieved due to the fact that molding can be performed with the identical molds.

Powder of a metallic or non-metallic soft magnetic material can be used as the magnetic powder of the composite material. Examples of the metal include pure iron substantially composed of Fe, an iron-based alloy including various additional elements, the remaining portion being composed of Fe and unavoidable impurities, an iron group metal other than Fe, an alloy thereof, or the like. Examples of the iron-based alloy include Fe—Si alloy, Fe—Si—Al alloy, Fe—Ni alloy, Fe—C alloy, and the like. Examples of the non-metal include ferrite.

A thermosetting resin, a thermoplastic resin, a room-temperature curable resin, a low-temperature curable resin, and the like can be used as the resin of the composite material. Examples of the thermosetting resin include: unsaturated polyester resin; epoxy resin; urethane resin; and silicone resin. Examples of the thermoplastic resin include PPS resin, PTFE resin, LCP, PA resin, PI resin, PBT resin, and ABS resin. In addition, it is also possible to use: a BMC (bulk molding compound), which is obtained by mixing calcium carbonate and glass fibers into unsaturated polyester; a mineral-type silicone rubber; a mineral-type urethane rubber; or the like. The content of the magnetic powder in the composite material may be 30 vol % or more and 80 vol % or less, or 50 vol % or more and 75 vol % or less. The content of the resin in the composite material may be 10 vol % or more and 70 vol % or less, and 20 vol % or more and 50 vol % or less. Also, the composite material can contain a filler powder composed of a non-magnetic and non-metal material such as alumina or silica, in addition to the magnetic powder and the resin. The content of the filler powder may be, for example, 0.2 mass % or more and 20 mass % or less, 0.3 mass % or more and 15 mass % or less, or 0.5 mass % or more and 10 mass % or less. The greater the content of the resin is, the smaller the relative permeability is, and thus the less likely magnetic saturation is to occur, the more the insulation can be increased, and the more likely the eddy current loss is to be reduced. In the case of including the filler powder, low iron loss resulting from an improvement in insulation, an improvement in the heat dissipation property, and the like can be expected.

Projections

As shown in FIG. 2, the projections 311 are integrally molded with and protrude from the outer peripheral surfaces of the inner core portions 31 and position the wound portions 2*c* in radial directions by coming into contact with the inner peripheral surfaces of the wound portions 2*c*. Also, due to the projections 311, the contact surface area between the inner peripheral surfaces of the wound portions 2*c* and the outer peripheral surfaces of the inner core portions 31 decreases, and it is possible to expect an effect of being able to reduce frictional resistance when inserting the inner core portions 31 into the wound portions 2*c*. In this example, the inner core portions 31 are rectangular column-shaped bodies, and the outer peripheral surfaces of the inner core portions 31 each include four flat surfaces (an upper surface, a lower surface, and left and right side surfaces) and four corner portions 313. The projections 311 are formed on the surfaces forming the outer peripheral surfaces of the inner core portions 31, and protrude from the central portions (portions excluding the corner portions 313) of the surfaces forming the outer peripheral surfaces in a cross section (horizontal cross section) perpendicular to the axial direction of the inner core portions 31. The shape and number of the projections 311 are not particularly limited. In this example, the cross-sectional shape of the projections 311 is rectangular, but may also be trapezoidal, semicircular, or the like. Also, although one projection 311 is formed at the intermediate position of each surface, multiple projections 311 may be provided for each surface, and multiple projections 311 may be formed at the intermediate portion of each surface. The clearances 34 (see FIG. 7) are formed between the inner peripheral surfaces of the wound portions 2*c* and the outer peripheral surfaces of the inner core portions 31 excluding the projections 311. The clearances 34 are flow paths of resin at a time of filling with resin that forms the later-described inner resin portions 41 (see FIG. 2), and due to the resin filling the clearances 34, the inner resin portions 41 are formed. In this example, four projections 311 are formed on the outer peripheral surface of the inner core portion 31, and the clearances 34 are ensured at the four corners of the inner core portion 31.

The height of the projections 311 may be 100 μm or more and 1 mm or less, for example. Due to the height of the projections 311 being 1 mm or less, the clearances 34 between the wound portions 2*c* and the inner core portions 31 can be made sufficiently small. Due to the height of the projections 311 being 100 μm or more, the flow path cross-sectional area of the clearance 34 that is to be the flow path of the resin is easily ensured. The height of the projections 311 is more preferably 200 μm or more and 800 μm or less, for example. In this example, the heights of the projections are the same.

The width of the projections 311 may be 1 mm or more and 20 mm or less, for example. "Width" in this context means the length in the peripheral direction of the outer peripheral surface of the inner core portion 31. Due to the width of the projections 311 being 1 mm or more, it is easy to ensure the mechanical strength of the projections 311, and due to the width being 20 mm or less, the flow path cross-sectional area of the clearance 34 is easily ensured. From the viewpoint of ensuring the flow path cross-sectional area of the clearance 34, the width of the projections 311 is more preferably ½ or less, and ⅓ or less, for example, of the width of the surface on which the projection 311 is formed, among the outer peripheral surfaces of the inner core portions 31.

Figure 7:
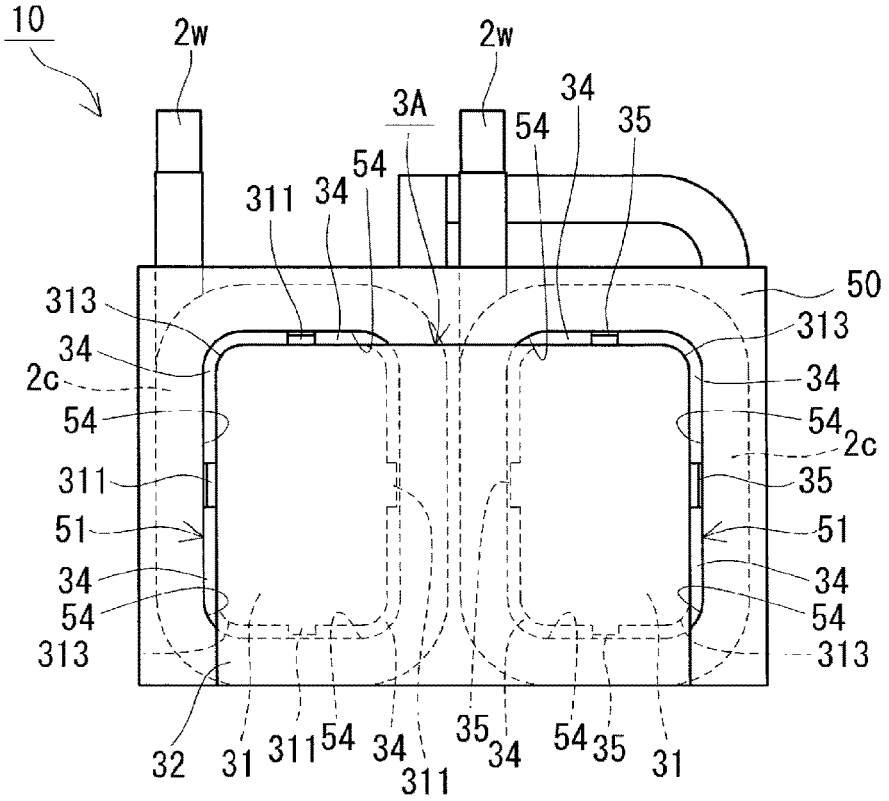
FIG. 7 is a schematic front view of the combined body shown in FIG. 4, viewed from the front surface side.

In this example, as shown in FIG. 6, the projections 311 are formed continuously along the entire length in the axial direction of the inner core portion 31. Accordingly, as shown in FIG. 7, the clearances 34 are divided in the peripheral direction by the projections 311 over the axial direction of the inner core portions 31. Due to the projections 311 being formed continuously over the entire length of the inner core portion 31, it is possible to prevent a case in which some turns forming the wound portions 2*c* shift in radial directions. The projections 311 may also be formed intermittently at an interval in the axial direction of the inner core portions.

Also, the corner portions 313 of the inner core portions 31 may be chamfered. Due to the corner portions 313 of the inner core portions 31 being chamfered, the clearances 34 at the corner portions 313 are larger, the flow paths of the resin (flow path cross-sectional area) are easily ensured, and the formation of the inner resin portions 41 is easier. The magnetic flux is not likely to flow in the corner portions 313 of the inner core portions 31, and the corner portions 313 are not likely to function as effective magnetic paths, and therefore have a comparatively small influence on the effective magnetic path. For this reason, due to the corner portions 313 of the inner core portions being chamfered, it is possible to effectively suppress reduction of the effective magnetic path cross-sectional area while ensuring the flow paths of the resin.

The chamfering may be R chamfering or C chamfering. The size of the chamfering need only be set as appropriate, but for example, in the case of R chamfering, it may be R 0.5 mm or more and R 5.0 mm or less, or R 1.0 mm or more and R 4.0 mm or less, and in the case of C chamfering, it may be C 0.5 mm or more and C 5.0 mm or less, or C 1.0 mm or more and C 4.0 mm or less. If the chamfering is too small, the effect of ensuring the flow paths of the resin will be small, and if the chamfering is too large, the effective magnetic path will be influenced, and the effect of suppressing reduction of the effective magnetic path cross-sectional area will be small.

Insulating Layer

In this example, as shown in FIGS. 2 and 3, the insulating layers 35 are arranged on the outer peripheral surfaces of the projections 311. The insulation layers 35 are interposed between the inner peripheral surfaces of the wound portions 2*c* and the outer peripheral surfaces of the projections 311, and ensure electrical insulation between the wound portions 2*c* and the inner core portions 31. The thickness of the insulation layers 35 need only be a thickness according to which it is possible to ensure insulation between the wound portions 2*c* and the inner core portions 31, and for example, may be 10 μm or more and 500 μm or less. Due to the thickness of the insulation layers 35 being 500 μm or less, the clearances 34 (see FIG. 7) between the wound portions 2*c* and the inner core portions 31 can be made sufficiently small. Due to the thickness of the insulation layers 35 being 10 μm or more, the insulation between the wound portions 2*c* and the inner core portions 31 can be sufficiently ensured. The thickness of the insulation layers 35 is more preferably 20 μm or more and 400 μm or less, for example. In this example, the insulation layers 35 are arranged on the outer peripheral surfaces of the projections 311 near the inner peripheral surfaces of wound portions 2*c*, but the insulation layers 35 need only be arranged on at least the outer peripheral surfaces of the projections 311, and may be arranged so as to surround the projections 311. If the insulation layers 35 are arranged on the outer peripheral surfaces of the projections 311, the total dimension obtained by adding the heights of the projections 311 and the thicknesses of the insulation layers 35 is preferably 110 μm or more and 1 mm or less, for example.

The insulation layers 35 are made of a material having an electrical insulation property. Also, it is desirable that the insulation layers 35 are as thin as possible, and from this viewpoint, for example, the insulation layers 35 may be formed by adhering insulating tape made of insulating paper or resin, or applying a resin powder coating material or an insulating coating material such as varnish. Epoxy resin, polyester resin, acrylic resin, fluororesin, or the like can be used as the resin of the powder coating material.

End Surface Interposed Member

As shown in FIGS. 4 and 5, the end surface interposed members 50 are interposed between the end surfaces of the wound portions 2*c* and the inner end surfaces 32*e* of the outer core portions 32, and ensure electrical insulation between the wound portions 2*c* and the outer core portions 32. As shown in FIG. 5, the end surface interposed members 50 are rectangular frame-shaped bodies in which two through holes 51 are formed, the inner core portions 31 of the core pieces 3A and 3B being inserted into the through holes 51. The opening shape of the through holes 51 is a rectangular shape. Also, in this example, groove portions 52 in which the end portions of the wound portions 2*c* are stored are formed in the wound portion 2*c* side (back surface side) of the end surface interposed members 50, and the wound portions 2*c* can be positioned with respect to the end surface interposed members 50 using the groove portions 52.

When the end surface interposed members 50 are arranged on the core pieces 3A and 3B, as shown in FIG. 7, resin filling holes 54 are formed at the four corners of the through holes 51 of the end surface interposed members 50. The resin filling holes 54 penetrate through the clearances 34 between the wound portions 2*c* and the inner core portions 31, and the clearances 34 can be filled with resin through the resin filling holes 54.

The end surface interposed members 50 are made of resin having an electrical insulating property, and for example, may be made of a resin such as epoxy resin, unsaturated polyester resin, urethane resin, silicone resin, PPS resin, PTFE resin, LCP, PA resin, PI resin, PBT resin, and ABS resin.

Inner Resin Portion

As shown in FIG. 2, the inner resin portions 41 are formed due to the spaces between the inner peripheral surfaces of the wound portions 2*c* and the outer peripheral surfaces of the inner core portions 31 excluding the projections 311 (the clearances 34 shown in FIG. 7) being filled with resin. Accordingly, the inner core portions 31 can be held inside of the wound portions 2*c*. The inner resin portions 41 are in close contact with the inner peripheral surfaces of the wound portions 2*c* and the outer peripheral surfaces of the inner core portions 31. The inner resin portions 41 can be formed by injection-molding the resin in the clearances 34.

The inner resin portions 41 are made of resin that has an electrical insulation property. A thermosetting resin, a thermoplastic resin, a room-temperature curable resin, a low-temperature curable resin, and the like can be used as the resin for forming the inner resin portion 41. For example, a thermosetting resin such as epoxy resin, unsaturated polyester resin, urethane resin, and silicone resin, or a thermoplastic resin such as PPS resin, PTFE resin, LCP, PA resin, PI resin, PBT resin, and ABS resin can be used.

In this example, as shown in FIG. 1, outer resin portions 42 are included which cover at least part of the outer surfaces of the outer core portions 32. The outer resin portions 42 are molded integrally with the inner resin portions 41, and in the reactor 1 shown in FIG. 1, the molded resin portion 4 is constituted by the inner resin portions 41 and the outer resin portions 42. The core pieces 3A and 3B are integrated by the molded resin portion 4.

Method for Manufacturing Reactor

An example of a method for manufacturing the reactor 1 will be described. The method for manufacturing the reactor is divided into two steps: a combined body assembly step and a resin filling step.

Combined Body Assembly Step

In the combined body assembly step, a combined body 10 (see FIG. 4) obtained by combining the coil 2 and the magnetic core 3 is assembled.

In this example, as shown in FIGS. 4 and 5, the two inner core portions 31 of the core pieces 3A and 3B are inserted into the through holes 51 of the end surface interposed members 50, and the end surface interposed members 50 are arranged on the core pieces 3A and 3B. The inner core portions 31 of the core pieces 3A and 3B are inserted into the two wound portions 2*c* from both sides of the two wound portions 2*c* of the coil 2, and the end surfaces of the two inner core portions 31 of the core pieces 3A and 3B abut against each other. Accordingly, the core pieces 3A and 3B are assembled in a ring shape and a ring-shaped magnetic core 3 (see FIG. 3) is formed. As described above, the combined body 10 including the coil 2, the magnetic core 3, and the end surface interposed members 50 is assembled.

Resin Filling Step

In the resin filling step, the inner resin portions 41 (see FIG. 2) are formed by filling the clearances 34 between the wound portions 2*c* and the inner core portions 31 (see FIG. 7) with resin.

In this example, the combined body 10 is set in a mold (not shown) and the two core pieces 3A and 3B and the end surface interposed members 50 are fixed to the mold. In this state, the resin is injected from the outer core portion 32 side of the combined body 10 to introduce the resin into the clearances 34 through the resin filling holes 54 of the end surface interposed members 50, and the resin fills the clearances 34 in the length direction (see FIG. 7). Thereafter, the resin filling the clearances 34 is solidified, whereby the inner resin portions 41 are formed (see FIG. 2). Also, in this example, at the same time as the formation of the inner resin portions 41, the outer resin portions 42 are formed so as to cover the outer core portions 32 with resin as well, and thus the inner resin portions 41 and the outer resin portions 42 are integrally molded. Accordingly, the molded resin portion 4 is formed by the inner resin portions 41 and the outer resin portions 42, and the core pieces 3A and 3B are integrated.

In the filling of the clearances 34 with the resin, the clearances 34 may be filled with the resin from one outer core portion 32 side to another outer core portion 32 side, or the clearances 34 may be filled with the resin from both outer core portion 32 sides.

Here, as described above, the projections 311 integrally molded on the outer peripheral surfaces of the inner core portions 31 are formed along the axial direction of the inner core portions 31 (see FIG. 6), and therefore the resin easily flows along the axial direction of the inner core portions 31 when the clearances 34 are filled with the resin, and the filling with the resin is easier. Also, the projections 311 are formed continuously along the entire length of the inner core portions 31, and therefore the clearances 34 are divided in the peripheral direction by the projections 311. For this reason, it is possible to suppress the occurrence of a weld caused by merging of the resin flowing in the adjacent clearances on both sides of a projection 311, and it is possible to avoid a case in which a weld is formed on the inner resin portions 41.

Actions and Effects

The reactor 1 of Embodiment 1 exhibits the following actions and effects.

Due to the core pieces 3A and 3B forming the magnetic core 3 being molded bodies of a composite material, magnetic flux leakage is not likely to occur in the magnetic core 3 (inner core portion 31), and the clearances 34 between the wound portions 2*c* and the inner core portions 31 can be made smaller. Also, by positioning the wound portions 2*c* in radial directions using the projections 311 that are integrally molded with and protrude from the outer peripheral surfaces of the inner core portions 31, the conventionally-used inner interposed member can be omitted, and it is possible to narrow the clearances 34 between the wound portions 2*c* and the inner core portions 31 and to position the wound portions 2*c* and the inner core portions 31. Accordingly, in the reactor 1, the wound portions 2*c* and the inner core portions 31 can be positioned with a simple configuration, the clearances 34 between the wound portions 2*c* and the inner core portions 31 can be reduced in size, and a smaller size of the reactor 1 can be achieved.

Application

The reactor 1 of Embodiment 1 can be suitably used as various types of converters, such as a converter for an air conditioner or an in-vehicle converter (typically a DC-DC converter) to be mounted in a vehicle such as a hybrid automobile, a plug-in hybrid automobile, an electric automobile, or a fuel cell automobile, and as a constituent component of a power conversion apparatus.

Modified Examples

Figure 8:
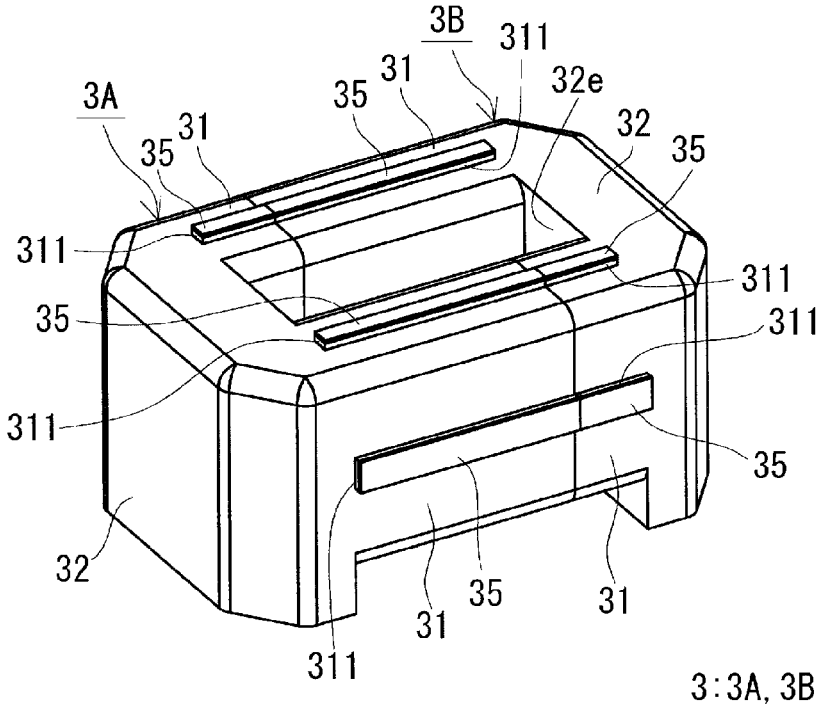
FIG. 8 is a schematic perspective view showing a modified example of a magnetic core.
Figure 9:
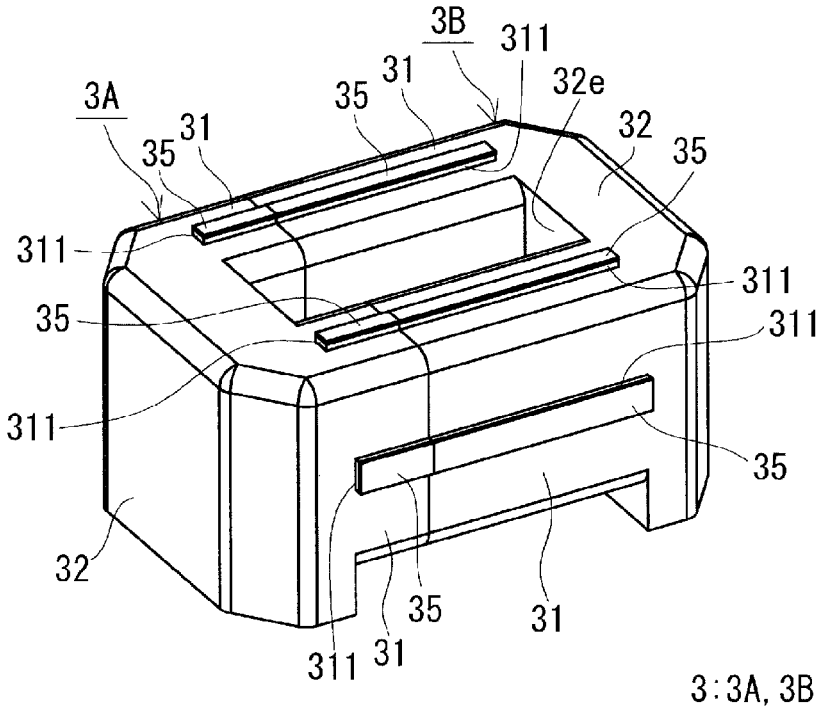
FIG. 9 is a schematic perspective view showing another modified example of a magnetic core.

With the reactor 1 of Embodiment 1 above, a mode was described with reference to FIG. 3, in which the lengths in the axial direction of the inner core portions 31 of the core pieces 3A and 3B forming the magnetic core 3 (the protrusion lengths from the inner end surfaces 32*e* of the outer core portions 32) are the same. There is no limitation to this, and the lengths of the inner core portions 31 of the core pieces 3A and 3B may also be different. For example, a mode may be used in which the lengths of the two inner core portions 31 of the core pieces 3A and 3B are alternately different as shown in FIG. 8, and a mode may be used in which the length of one of the two inner core portions of the core pieces 3A and 3B is short and the other of the two inner core portions 31 is long as shown in FIG. 9. In the cases of the core pieces 3A and 3B shown in FIGS. 8 and 9, when the magnetic core 3 is formed, the positions at which the two inner core portions 31 abut against each other is shifted from the intermediate position in the length direction of the magnetic core 3.

As described in Embodiment 1, when the inner resin portion 41 is formed by filling the clearances 34 between the wound portions 2*c* and the inner core portions 31 with resin, the clearances 34 are filled with the resin from both sides in some cases, as described above. In this case, when performing filling with the resin using the same injection force, a weld occurs due to resin merging at the intermediate position in the lengthwise direction of a clearance 34, and a weld portion with low strength is formed at the intermediate portion of the inner resin portion 41 in some cases.

Vibration occurs due to magnetic warping in the magnetic core 3, and stress tends to be applied at the abutting positions of the core pieces 3A and 3B. In the case of the modified examples shown in FIGS. 8 and 9 above, the abutting positions of the core pieces 3A and 3B and the positions of the weld portions are misaligned. For this reason, the stress that acts on the weld portions can be reduced, and it is possible to significantly reduce a case in which cracking or breaking occurs in the inner resin portion 41 with the weld portion as the origin.

The invention claimed is:

1. A reactor including: a coil having wound portions; and a magnetic core including core pieces having inner core portions arranged inside of the wound portions, wherein the core pieces are molded bodies of a composite material including a magnetic powder and a resin, and the reactor comprises:

projections that are integrally molded with and protrude from outer peripheral surfaces of the inner core portions, and that position the wound portions in radial directions by coming into contact with inner peripheral surfaces of the wound portions; and inner resin portions that fill spaces between the inner peripheral surfaces of the wound portions and the outer peripheral surfaces of the inner core portions excluding the projections, and the projections are formed continuously over the entire length along an axial direction of the inner core portions.

2. The reactor according to claim 1, wherein the height of the projections is 1 mm or less.

3. The reactor according to claim 1, wherein corner portions of the inner core portions are chamfered.

4. The reactor according to claim 1, comprising insulation layers that are arranged on outer peripheral surfaces of the projections and are interposed between the inner peripheral surfaces of the wound portions and the outer peripheral surfaces of the projections.

5. The reactor according to claim 4, wherein the thickness of the insulating layers is 500 μm or less.

6. The reactor according to claim 2, wherein corner portions of the inner core portions are chamfered.

7. The reactor according to claim 2, comprising insulation layers that are arranged on outer peripheral surfaces of the projections and are interposed between the inner peripheral surfaces of the wound portions and the outer peripheral surfaces of the projections.

8. The reactor according to claim 3, comprising insulation layers that are arranged on outer peripheral surfaces of the projections and are interposed between the inner peripheral surfaces of the wound portions and the outer peripheral surfaces of the projections.

* * * * *